US008668447B2

(12) United States Patent
Sayano et al.

(10) Patent No.: US 8,668,447 B2
(45) Date of Patent: Mar. 11, 2014

(54) STEAM TURBINE BLADE AND METHOD FOR MANUFACTURING THE SAME

(75) Inventors: Akio Sayano, Yokohama (JP); Masashi Takahashi, Yokohama (JP); Masahiro Saito, Yokohama (JP); Kazuyoshi Nakajima, Hiratsuka (JP); Jianshun Huang, Yokohama (JP); Kazuhiko Mori, Atsugi (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 606 days.

(21) Appl. No.: 12/640,577

(22) Filed: Dec. 17, 2009

(65) Prior Publication Data

US 2010/0166548 A1 Jul. 1, 2010

(30) Foreign Application Priority Data

Dec. 26, 2008 (JP) ..... P2008-335313
Oct. 29, 2009 (JP) ..... P2009-248559

(51) Int. Cl.
*F01D 5/28* (2006.01)

(52) U.S. Cl.
USPC ..... 415/200; 416/241 B

(58) Field of Classification Search
USPC ..... 416/241 B; 415/200
See application file for complete search history.

(56) References Cited

U.S. PATENT DOCUMENTS

| | | | | |
|---|---|---|---|---|
| 4,537,632 | A * | 8/1985 | Mosser | 106/14.12 |
| 5,789,077 | A | 8/1998 | Nakahama et al. | |
| 6,521,293 | B1 * | 2/2003 | Kojima et al. | 427/250 |
| 6,986,951 | B2 | 1/2006 | Giannozzi | |
| 2002/0025454 | A1 * | 2/2002 | Wang et al. | 428/698 |
| 2007/0017653 | A1 * | 1/2007 | Persky et al. | 164/516 |
| 2007/0101719 | A1 | 5/2007 | Niizeki et al. | |
| 2007/0289490 | A1 * | 12/2007 | Jabado et al. | 106/286.3 |
| 2008/0166587 | A1 | 7/2008 | Barnikel et al. | |
| 2008/0280103 | A1 * | 11/2008 | Uetsuka et al. | 428/148 |
| 2009/0176110 | A1 * | 7/2009 | Pabla et al. | 428/450 |
| 2011/0027385 | A1 * | 2/2011 | Cairns et al. | 424/618 |

FOREIGN PATENT DOCUMENTS

| | | |
|---|---|---|
| EP | 0 690 144 B1 | 11/2001 |
| EP | 1 403 397 A1 | 3/2004 |
| EP | 1 780 379 A2 | 5/2007 |
| JP | 8-74024 | 3/1996 |

(Continued)

OTHER PUBLICATIONS

Office Action issued Sep. 18, 2012 in Japanese Patent Application No. 2009-248559 with English language translation.

*Primary Examiner* — Edward Look
*Assistant Examiner* — Liam McDowell
(74) *Attorney, Agent, or Firm* — Oblon, Spivak, McClelland, Maier & Neustadt, L.L.P.

(57) ABSTRACT

A steam turbine blade includes a coating film formed at least a portion of a surface of the steam turbine blade, the coating film containing a ceramic matrix and nanosheet particles dispersed in the ceramic matrix. The steam turbine blade is employed as one of stator blades or one of rotor blades in a steam turbine. The steam turbine includes a turbine rotor, the rotor blades implanted in the turbine rotor, the stator blades provided in an upstream side of the corresponding rotor blades, and a turbine casing supporting the stator blades and accommodating turbine rotor, the rotor blades and the stator blades. The steam turbine is also configured such that the rotor blades are paired with the corresponding stator blades to form turbine stages arranged in an axial direction of the turbine rotor, thereby forming steam paths.

8 Claims, 2 Drawing Sheets

(56) References Cited

FOREIGN PATENT DOCUMENTS

| | | |
|---|---|---|
| JP | 8-74025 | 3/1996 |
| JP | 2002-38281 | 2/2002 |
| JP | 2004-169176 | 6/2004 |
| JP | 2005-290369 A | 10/2005 |
| JP | 2006-37212 | 2/2006 |
| JP | 2007-119802 | 5/2007 |
| JP | 2007-120478 A | 5/2007 |

* cited by examiner

STEAM TURBINE BLADE AND METHOD FOR MANUFACTURING THE SAME

CROSS-REFERENCE TO RELATED APPLICATIONS

This application is based upon and claims the benefit of priority from the prior Japanese Patent Applications No. 2008-335313 filed on Dec. 26, 2008 and No. 2009-248559 filed on Oct. 29, 2009; the entire contents which are incorporated herein by reference.

BACKGROUND

1. Field of the Invention

The present invention relates to a steam turbine blade and a method for manufacturing the steam turbine blade, particularly which can maintain and develop the aerodynamic characteristics of the rotor blades (blades) and the stator blades (nozzles) composing the steam turbine and thus the performance of the steam turbine.

2. Background of the Invention

In a steam turbine, the pressure and high temperature energy of the high temperature and high pressure steam supplied from the boiler is converted into the corresponding rotational energy using the turbine cascade of the rotor blades and the stator blades. FIG. 3 is a conceptual view about a power generating system using such a steam turbine.

As shown in FIG. 3, a steam generated at a boiler 1 is heated again at a superheater 2 and then supplied to a steam turbine 3.

The steam turbine 3 is configured so as to have a plurality of turbine stages which are arranged in the axial direction of a turbine rotor 4, each turbine stage being constituted from rotor blades implanted in the turbine rotor 4 along the circumferential direction thereof and stator blades (nozzles) supported by a casing. Then, the steam supplied to the steam turbine 3 is expanded in the steam path so that the high temperature and high pressure energy is converted into the rotational energy at the turbine rotor 4.

The rotational energy of the turbine rotor 4 is transmitted to a turbine generator 9 connected with the turbine rotor 4 and thus converted into the corresponding electric energy. On the other hand, the steam, from which the high temperature and high pressure energy is extracted, is discharged from the steam turbine 3 and supplied to a steam condenser 10 so as to be cooled down by a cooling medium 11 such as seawater and then converted into the corresponding condensed water. The condensed water is supplied again to the boiler 1 by a feed pump 12.

By the way, the steam turbine 3 is divided into a high pressure turbine, an intermediate pressure turbine and a low pressure turbine commensurate with the temperature and pressure condition of the steam to be supplied. In such a power generating system, since the stages of the high pressure turbine and the intermediate pressure turbine suffer from the high temperature condition, the rotor blades and stator blades of the stages of the high pressure turbine and the intermediate pressure turbine may be oxidized remarkably.

When the rotor blades and the stator blades are incorporated as parts of the steam turbine, the surface roughness of the rotor blades and the stator blades are reduced as possible by blowing minute particles off onto the surfaces of the rotor blades and the stator blades because the flow of a fluid fluctuates on the surfaces of the rotor blades and the stator blades and thus separate from the surfaces thereof so as to lower the aerodynamic characteristics of the rotor blades and the stator blades and deteriorate the turbine efficiency entirely if the surface roughness of the rotor blades and the stator blades is enlarged.

Such a problem is pointed out as the rotor blades and the stator blades can exhibit excellent aerodynamic characteristics at the initial stage because the surface roughness of the rotor blades and the stator blades is small, but cannot exhibit the excellent aerodynamic characteristics with the operation period of time because the surfaces of the rotor blades and the stator blades are oxidized gradually to coarsen the surface roughness of the rotor blades and the stator blades and then to deteriorate the aerodynamic characteristics thereof, resulting in the deterioration of the entire turbine efficiency. The techniques relating to the above-described problem are proposed as below.

In order to enhance the corrosion-resistance, oxidation-resistance and fatigue strength of the steam turbine parts, it is proposed that a nitrided hard layer (radical nitrided layer) is formed on the steam turbine parts and then a physical evaporation hard layer made of, e.g., CrN, TiN, AlCrN is formed thereon (refer to Reference 1).

Moreover, nickel plating is conducted for a high temperature member for the steam turbine rotors so that the thus plated member is borided to form a layer made of iron boride and nickel boride at the surfaces of the steam turbine rotors, thereby enhancing the corrosion-resistance and the high temperature erosion-resistance of the steam turbine rotors (refer to Reference 2).

Furthermore, a $Cr_{23}C_6$ layer is formed at the steam turbine blades by means of the combination of plating and thermal treatment so as to enhance the corrosion-resistance, wear-resistance and the erosion-resistance of the steam turbine blades (refer to References 3 and 4).

In addition, it is proposed that the corrosion-resistance of the steam turbine blades is enhanced by means of laser plating where a cobalt alloy with strictly controlled composition is contacted with a base material, and then melted and adhered with the base material by means of laser (refer to Reference 5).

[Reference 1] JP-A 2006-037212 (KOKAI)
[Reference 2] JP-A 2002-038281 (KOKAI)
[Reference 3] JP-A 08-074024 (KOKAI)
[Reference 4] JP-A 08-074025 (KOKAI)
[Reference 5] JP-A 2004-169176 (KOKAI)

However, the above-described conventional techniques require complicated processes, respectively, resulting in the increase of the manufacturing cost. Moreover, the conventional techniques enlarge the surface roughness of the steam turbine rotors through the formation of the layer, resulting in the inherent deterioration of the initial turbine performance. In this point of view, such a method as enhancing the oxidation-resistance of the steam turbine blades under the condition that the initial surface roughness of the steam turbine blades is not changed is not proposed as of now.

BRIEF SUMMARY OF THE INVENTION

It is an object of the present invention, in light of the conventional problems, to provide a steam turbine blade and a method for manufacturing the same whereby the corrosion-resistance of the steam turbine blade can be enhanced under the condition that the initial surface roughness of the steam turbine blade is not changed and the manufacturing process of the steam turbine blade can be simplified so as to reduce the manufacturing cost of the steam turbine blade.

The inventors had intensely studied the structure of the steam turbine blade for maintaining the inherent turbine performance. As a result, the inventors found out the following facts of matter. Namely, if a coating film containing a ceramic matrix and nanosheet particles dispersed in the ceramic matrix is formed at the steam turbine blade, the oxidation-resistance of the steam turbine blade can be enhanced. Moreover, if the coating film is formed by means of solution method including a coating step of a solution and a heating step of the solution, the oxidation-resistance of the steam turbine blade is enhanced under the condition of no increase of surface roughness thereof. In this point of view, the inventors have conceived the present invention.

An aspect of the present invention relates to a steam turbine blade, including: a coating film formed at least a portion of a surface of the steam turbine blade, the coating film containing a ceramic matrix and nanosheet particles dispersed in the ceramic matrix, wherein the steam turbine blade is employed as one of stator blades or one of rotor blades in a steam turbine, the steam turbine including a turbine rotor, the rotor blades implanted in the turbine rotor, the stator blades provided in an upstream side of the corresponding rotor blades, and a turbine casing supporting the stator blades and accommodating the turbine rotor, the rotor blades and the stator blades, the steam turbine being configured such that the rotor blades are paired with the corresponding stator blades to form turbine stages arranged in an axial direction of the turbine rotor, thereby forming steam paths.

Another aspect of the present invention relates to a method for manufacturing a steam turbine blade to be employed as one of stator blades or one of rotor blades in a steam turbine, the steam turbine including a turbine rotor, the rotor blades implanted in the turbine rotor, the stator blades provided in an upstream side of the corresponding rotor blades, and a turbine casing supporting the stator blades and accommodating the turbine rotor, the rotor blades and the stator blades, the steam turbine being configured such that the rotor blades are paired with the corresponding stator blades to form turbine stages arranged in an axial direction of the turbine rotor, thereby forming steam paths, including: coating a solution containing a ceramic precursor to be a ceramic matrix and nanosheet particles at a surface of the steam turbine blade; and heating the solution coated thereat to form a coating film containing the ceramic matrix and the nanosheet particles dispersed in the ceramic matrix.

According to the present invention can be provided a steam turbine blade and a method for the same whereby the corrosion-resistance of the steam turbine blade can be enhanced under the condition that the initial surface roughness of the steam turbine blade is not changed and the manufacturing process of the steam turbine blade can be simplified so as to reduce the manufacturing cost of the steam turbine blade.

BEST MODE FOR IMPLEMENTING THE INVENTION

Hereinafter, the present invention will be described in detail with reference to the drawings.

Figure 1:
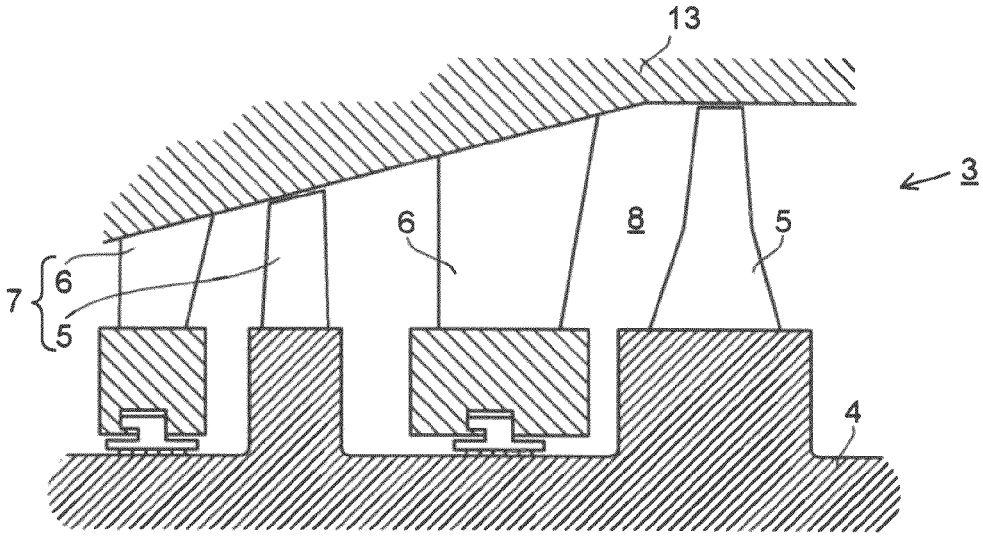
FIG. 1 is a cross-sectional view schematically showing a main part of a steam turbine according to an embodiment of the present invention.

FIG. 1 shows the structure of the steam turbine and the steam turbine blades according to an embodiment. As shown in FIG. 1, a steam turbine 3 includes a turbine rotor 4, rotor blades 5 implanted in the turbine rotor 4, stator blades 6 provided in the upstream side of the corresponding rotor blades 5 and a turbine casing 13 supporting the stator blades 6 and accommodating the turbine rotor 4, the rotor blades 5 and the stator blades 6. One of the rotor blades 5 is paired with one of the stator blades 6 to form one turbine stage 7. The thus obtained turbine stages 7 are arranged in the axial direction of the turbine rotor 4 to form steam paths 8. Then, coating films made from respective ceramic matrixes and nanosheet particles contained and dispersed in the respective ceramic matrixes are formed on at least portions of the surfaces of the stator blades 6 and the rotor blades 5 (in this embodiment, the coating films being formed over the surfaces of the stator blades 6 and the rotor blades 5). Therefore, the energy loss of a steam flow due to the increase in surface roughness of the rotor blades 5 and the stator blades 6 originated from the oxidation thereof can be prevented. Here, the steam paths 8 defined by the corresponding stator blade 6, the corresponding rotor blade 5, corresponding end walls and corresponding platforms are called as "steam turbine blade"s.

Here, the ceramic matrix may be crystalline or amorphous.

In this embodiment, since the dense coating films, which are made from respective ceramic matrixes and nanosheet particles contained and dispersed in the respective ceramic matrixes, are formed at least portions of the steam paths 8 defined by the corresponding stator blade 6, the corresponding rotor blade 5, the corresponding end walls and the corresponding platforms, respectively, the base materials of the steam turbine blades (steam paths 8) coated by the coating films are not exposed directly to oxygen in air so that the oxygen-resistance of the steam turbine blades can be enhanced under the condition that the surface roughness of the steam turbine blades is not almost changed in a high temperature atmosphere. Therefore, if the steam turbine blades are employed in a turbine plant, the forms and surface roughness of the steam turbine blades can be maintained for a long time so that the initial higher efficiency of the entire of the turbine can be maintained for a long time.

It is desired that the composition of the coating film is configured such that the rate of the nanosheet particle is set within a range of 1 vol % to 90 vol %. The reason the rate of the nanosheet particle is set within the above range is as follows. Namely, if the volume rate of the nanosheet particle is set less than 1 vol %, the oxidation-resistance of the steam turbine blades may not be improved sufficiently. On the other hand, if the volume rate of the nanosheet particle is set more than 90 vol %, the adhesion strength of the coating film is lowered and thus may be peeled off so that the coating film cannot be employed as desired in view of the practical use.

The nanosheet particles may be made from silicon oxide or titanium oxide. In this case, the nanosheet particles are formed as layered scrapings of the silicon oxide composition or the titanium oxide composition which have layered crystalline structures. As the silicon oxide composition with the layered crystalline structure, a natural silicon oxide composition such as clay mineral, kaolin mineral or mica mineral, and a synthesized layered silicate formed from a silicon component and an amine component as an organic crystallization adjusting agent may be exemplified. As the titanium oxide composition with the layered crystalline structure, a layered titanic acid ($H_xTi_{2-x/4}O_4.nH_2O$), tetratitanate salt ($K_2Ti_4O_9$), pentatitanate salt ($Cs_2Ti_5O_{11}$) or lepidocrocite titanate salt ($Cs_{0.7}Ti_{1.825}O_4$, $K_{0.8}Ti_{1.73}Li_{0.27}O_4$) may be exemplified. The layered scraping of the silicon oxide composition or the titanium oxide composition can be obtained through the ion exchange using alkylammonium.

Figure 2:
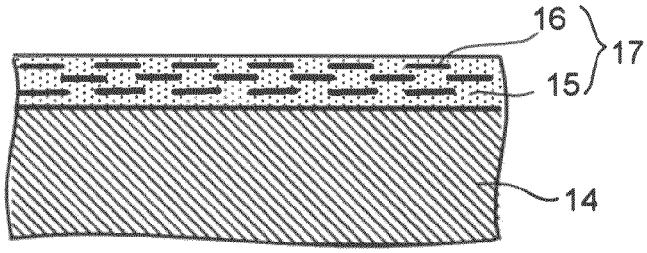
FIG. 2 is an enlarged cross-sectional view schematically showing the main part of a steam turbine blade according to an embodiment of the present invention.
Figure 3:
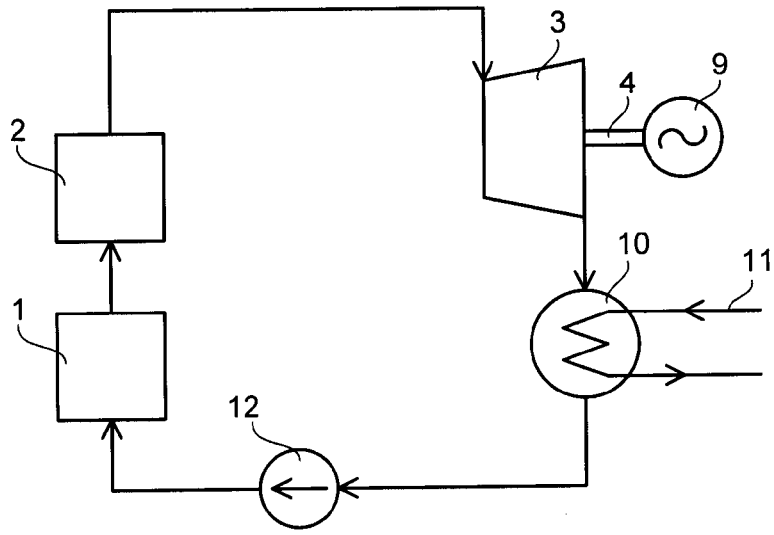
FIG. 3 Prior Art
FIG. 3 is a conceptual view about a Rankine cycle in a steam turbine power generating system.
Figure 4:
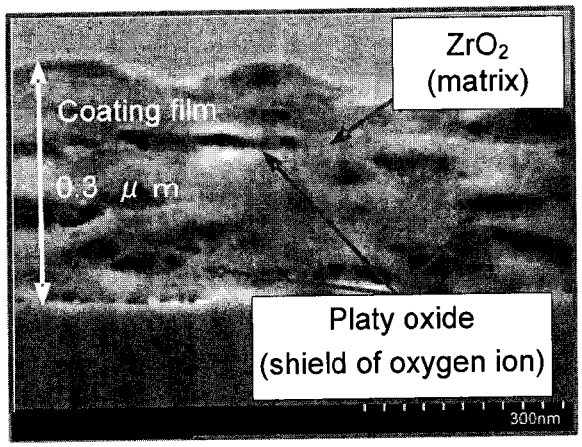
FIG. 4 is an electron microscope photograph of the cross section of a steam turbine blade according to an embodiment of the present invention.

The nanosheet particles of the coating film are sheet-like crystalline substances, respectively, and thus have higher oxygen barrier property due to the dense structure in comparison with amorphous substances. As shown in FIG. 2, the nanosheet particles 16 of the coating film 17 are oriented orthogonal to the thickness direction of the coating film 17, and functions as a barrier layer for the oxidation of the steam turbine blade base 14 so as to much more enhance the oxidation-resistance of the coating film 17 entirely. In FIG. 2, the reference numeral "15" designates an amorphous ceramic matrix of the coating film 17. Here, the electron microscope photograph of the cross section of the steam turbine blade according to this embodiment will be shown in FIG. 4.

With the coating film 17, it is desired that the thickness of the nanosheet particle is set within a range of 0.5 to 10 nm and the lateral size of the nanosheet particle is set within a range of 0.1 to 10 μm. The reason the thickness of the nanosheet particle is set within a range of 0.5 to 10 nm and the lateral size of the nanosheet particle is set within a range of 0.1 to 10 μm is as follows. If the thickness and lateral size is beyond the above ranges, the barrier property of the coating film for oxygen is deteriorated so that the steam turbine base may be oxidized and the coating film may be peeled off.

The ceramic matrix may be rendered amorphous. The ceramic matrix of the coating film may be preferably made by means of solution method as will described hereinafter. In this case, thermal treatment may be conducted so as not to damage the steam turbine base at a lower temperature. Here, the solution method means a method for forming a film using a ceramic precursor solution such as a complex, a sol or a metallic alkoxide. The coating of the solution may be conducted by means of dipping, spray, spin coating, roll coating, bar coating or the like.

The ceramic matrix is not limited to amorphous structure, but may be rendered crystalline structure through the thermal treatment at a lower temperature so as not to damage the steam turbine base by appropriately selecting the thermal treatment temperature.

As the ceramic precursor solution, a precursor solution of zirconium oxide, titanium oxide, silicon oxide, aluminum oxide may be exemplified. As the zirconium oxide precursor solution, a zirconium oxide sol obtained through the hydrolysis of zirconium alkoxide, a zirconium metal salt such as zirconium-hydrofluoric acid, zirconium aluminum carbonate, zirconium potassium fluoride, zirconium sodium fluoride, basic zirconium fluoride, zirconium nitrate, zirconium acetate, oxidized zirconium chloride, or a zirconium complex may be exemplified.

As the titanic oxide precursor solution, a titanium oxide sol obtained through the hydrolysis of titanium alkoxide, a zirconium metal salt such as titanium-hydrofluoric acid, titanium lactate, titanium tartrate, titanium acetate, oxidized titanium chloride, peroxotitanic acid or a titanic complex may be exemplified.

As the silicon oxide precursor solution, a silica sol obtained through the hydrolysis of silane coupling agent, methyl silicate, ethyl silicate, propyl silicate, butyl silicate or a silicate such as sodium silicate, potassium silicate, magnesium silicate, calcium silicate, barium silicate may be employed.

As the aluminum oxide precursor solution, an aluminum sol obtained through the hydrolysis of aluminum alkoxide, or a well known sol obtained by means of precipitation method using water soluble aluminum nitrate or aluminum sulfate as a raw material and sodium carbonate or sodium hydrate as a precipitating agent.

The thickness of the coating film is preferably set within a range of 0.01 to 10 μm. If the thickness of the coating film is set less than 0.01 μm, the coating film cannot cover the steam turbine base uniformly so that the steam turbine base may be partially exposed so as to deteriorate the oxidation-resistance of the coating film remarkably. On the other hand, if the thickness of the coating film is set more than 10 μm, the adhesion strength of the coating film for the steam turbine base so that some cracks may be created at the coating film so as to deteriorate the oxidation-resistance thereof. In the latter case, the coating film may be peeled off from the steam turbine base.

In one embodiment of the method for manufacturing a steam turbine blade, the coating film may be manufactured as follows. First of all, a solution containing a ceramic precursor to be a ceramic matrix and nanosheet particles is coated on the surface of the turbine blade and then heated to manufacture the coating film.

Here, the solution means a complex, sol or metal alkoxide as described above. The coating of the solution may be conducted by means of dipping, spray, spin coating, roll coating, bar coating or the like. The thermal treatment may be conducted such that the steam turbine base with the coated solution is kept in an electric furnace, namely, the steam turbine base is entirely heated or only the surface area of the steam turbine base is heated by means of irradiation of infrared ray. However, the thermal treatment is not limited to these methods.

In this embodiment, the intended coating film can be manufactured by the steps of coating on the surface of the turbine blade the solution containing the ceramic precursor and the nanosheet particles, and heating the coated solution. Therefore, the intended coating film can be manufactured simply at low cost. In this point of view, the manufacturing method of the coating film is practically usable so that the intended coating film can be manufactured uniformly, not almost causing the change in surface roughness of the steam turbine blade base and not requiring post-processing after the manufacture of the coating film.

The thermal treatment is preferably conducted within a temperature range of 80 to 600° C. If the thermal treatment is conducted at a temperature less than 80° C., the ceramic precursor such as the zirconium composition as described above may not be thermally dissolved sufficiently so as to manufacture the dense coating film, resulting in the change in property of the coating film with time and the peeling of the coating film through the instability thereof. On the other hand, if the thermal treatment is conducted at a temperature more than 600° C., the metallic structure of the steam turbine blade base may be changed and thus the inherent fatigue strength, creep strength and the like of the steam turbine blade base may be deteriorated.

Here, in order to render the ceramic matrix crystalline structure, the thermal treatment temperature is set to a higher temperature within the above-described temperature range. In order to render the ceramic matrix crystalline structure, the thermal treatment temperature is set to a lower temperature within the above-described temperature range.

EXAMPLES

Example 1

In this example, silicon oxide nanosheet particles, each having a lateral size of about 1 μm and a thickness of about 1 nm, were added into about 7 wt % zirconium acetate containing water solution. The amount of the nanosheet particles added into the water solution is set such that the amount of the zirconium oxide in the intended coating film was set to 70 vol % for all of the coating film after thermal treatment and the amount of the silicon oxide nanosheet particles was set to 30 vol % for all of the coating film after the thermal treatment. The thus obtained mixed solution was blended using a magnet stirrer and Teflon (registered trademark) rotator to form a slurry solution for coating. The thus obtained coating slurry was coated onto a high-chrome steel plate with a size of 50 mm×50 mm×1 mm by means of dipping, dried at room temperature for about one hour and heated at 300° C. for 5 minutes under atmosphere, thereby forming the intended coating film.

The thickness of the coating film was about 0.3 μm and the coating film was formed such that the crystalline silicon oxide nanosheet particles were dispersed in the amorphous zirconium oxide matrix and oriented orthogonal to the thickness direction of the coating film (as shown in FIG. 2).

An oxidation-resistance test was carried out for the coating film. In the oxidation-resistance test, the coating film was maintained at 400° C. for 100 hours under atmosphere so that the changes in weight and surface roughness of the coating film were examined. As a result, the weight change and surface roughness change of the coating film was not almost recognized.

Example 2

In this example, the intended coating film was formed in the same manner as Example 1 except that the amount of the silicon oxide nanosheet particles to be added into the slurry solution was decreased to 10 vol % for all of the coating film to be formed. Moreover, the oxidation-resistance test was also carried out in the same manner as Example 1. As a result, the weight change and surface roughness change of the coating film was not almost recognized.

Example 3

In this example, the intended coating film was formed in the same manner as Example 1 except that the amount of the silicon oxide nanosheet particles to be added into the slurry solution was increased to 80 vol % for all of the coating film to be formed. Moreover, the oxidation-resistance test was also carried out in the same manner as Example 1. As a result, the weight change and surface roughness change of the coating film was not almost recognized.

Example 4

In this example, the intended coating film was formed in the same manner as Example 1 except that the lateral size of each of the nanosheet particles was set to 0.1 μm. Moreover, the oxidation-resistance test was also carried out in the same manner as Example 1. As a result, the weight change and surface roughness change of the coating film was not almost recognized.

Example 5

In this example, the intended coating film was formed in the same manner as Example 1 except that the lateral size of each of the nanosheet particles was set to 10 μm. Moreover, the oxidation-resistance test was also carried out in the same manner as Example 1. As a result, the weight change and surface roughness change of the coating film was not almost recognized.

Example 6

In this example, the intended coating film was formed in the same manner as Example 1 except that titanium oxide nanosheet particles (each having a lateral size of about 1 μm and a thickness of about 1 nm, and having the amount of 30 wt % for all of the coating film to be formed) were employed instead of the silicon oxide nanosheet particles. Moreover, the oxidation-resistance test was also carried out in the same manner as Example 1. As a result, the weight change and surface roughness change of the coating film was not almost recognized.

Example 7

In this example, the intended coating film was formed in the same manner as Example 1 except that about 7 wt % zirconium ammonia carbonate containing water solution was employed instead of the zirconium acetate containing water solution as a precursor solution. Moreover, the oxidation-resistance test was also carried out in the same manner as Example 1. As a result, the weight change and surface roughness change of the coating film was not almost recognized.

Example 8

In this example, the intended coating film was formed in the same manner as Example 1 except that about 7 wt % peroxotitanic acid containing water solution was employed instead of the zirconium acetate containing water solution as a precursor solution. Moreover, the oxidation-resistance test was also carried out in the same manner as Example 1. As a result, the weight change and surface roughness change of the coating film was not almost recognized.

Example 9

In this example, the intended coating film was formed in the same manner as Example 1 except that about 7 wt % silica sol containing water solution, the silica sol being made through the hydrolysis of γ-glycidoxypropyltrimethoxysilane, was employed instead of the zirconium acetate containing water solution as a precursor solution. Moreover, the oxidation-resistance test was also carried out in the same manner as Example 1. As a result, the weight change and surface roughness change of the coating film was not almost recognized.

Example 10

In this example, the intended coating film was formed in the same manner as Example 1 except that about 7 wt % aluminum oxide sol containing water solution, the aluminum oxide sol being made through the hydrolysis of aluminum alkoxide, was employed instead of the zirconium acetate containing water solution as a precursor solution. Moreover, the oxidation-resistance test was also carried out in the same manner as Example 1. As a result, the weight change and surface roughness change of the coating film was not almost recognized.

Example 11

In this example, the intended coating film was formed in the same manner as Example 1 except that the thickness of the coating film to be formed was set to 0.01 μm. Moreover, the oxidation-resistance test was also carried out in the same manner as Example 1. As a result, the weight change and surface roughness change of the coating film was not almost recognized.

Example 12

In this example, the intended coating film was formed in the same manner as Example 1 except that the thickness of the coating film to be formed was set to 10 μm. Moreover, the oxidation-resistance test was also carried out in the same manner as Example 1. As a result, the weight change and surface roughness change of the coating film was not almost recognized.

Reference Example 1

In this example, the intended coating film was formed in the same manner as Example 1 except that the amount of the silicon oxide nanosheet particles to be added into the slurry solution was decreased to 0.5 vol % for all of the coating film to be formed. Moreover, the oxidation-resistance test was also carried out in the same manner as Example 1. As a result, the weight change and surface roughness change of the coating film was slightly recognized.

Reference Example 2

In this example, the intended coating film was formed in the same manner as Example 1 except that the amount of the silicon oxide nanosheet particles to be added into the slurry solution was decreased to 95 vol % for all of the coating film to be formed. Moreover, the oxidation-resistance test was also carried out in the same manner as Example 1. As a result, the weight change and surface roughness change of the coating film was slightly recognized.

Reference Example 3

In this example, the intended coating film was formed in the same manner as Example 1 except that the lateral size of each of the nanosheet particles was set to 0.08 μm. Moreover, the oxidation-resistance test was also carried out in the same manner as Example 1. As a result, the weight change and surface roughness change of the coating film was slightly recognized.

Reference Example 4

In this example, the intended coating film was formed in the same manner as Example 1 except that the lateral size of each of the nanosheet particles was set to 12 μm. Moreover, the oxidation-resistance test was also carried out in the same manner as Example 1. As a result, the weight change and surface roughness change of the coating film was slightly recognized.

Reference Example 5

In this example, the intended coating film was formed in the same manner as Example 1 except that the thickness of the coating film to be formed was set to 0.008 μm. Moreover, the oxidation-resistance test was also carried out in the same manner as Example 1. As a result, the weight change and surface roughness change of the coating film was slightly almost recognized.

Reference Example 6

In this example, the intended coating film was formed in the same manner as Example 1 except that the thickness of the coating film to be formed was set to 12 μm. Moreover, the oxidation-resistance test was also carried out in the same manner as Example 1. As a result, the weight change and surface roughness change of the coating film was slightly almost recognized.

As described above, it is turned out that the steam turbine blade relating to Examples have the respective high oxidation-resistance through the formation of the coating film containing the amorphous ceramic matrix and the nanosheet particles dispersed in the ceramic matrix. With the manufacture of the steam turbine blade relating to Examples, since the intended coating film is formed by means of the solution method, the initial surface roughness of the coating film is maintained as it is. Therefore, when the steam turbine blade is practically used in a plant, the initial shape and surface roughness of the steam turbine blade can be maintained so as not to deteriorate the aerodynamic characteristics of the steam turbine blade and thus maintain the initial high efficiency of the steam turbine blade for a long time.

In Examples, although the ceramic matrix has an amorphous structure, the ceramic matrix may have a crystalline structure. In the latter case, the same effect/function can be exhibited as described above.

What is claimed is:

1. A steam turbine blade, comprising:

a coating film formed on at least a portion of a surface of the steam turbine blade, the steam turbine blade being made of high-chrome steel, the coating film containing:

a ceramic matrix made of zirconium oxide; and nanosheet particles made from silicon oxide dispersed in the ceramic matrix, each of the nanosheet particles being oriented orthogonal to a thickness direction of the coating film so as to provide oxygen barrier property, each of the nanosheet particles being within a range of 0.5 to 10 nm in thickness and within a range of 0.1 to 10 μm in lateral size, wherein the steam turbine blade is employed as one of stator blades or one of rotor blades in a steam turbine, the steam turbine including a turbine rotor, the rotor blades implanted in the turbine rotor, the stator blades provided in an upstream side of the corresponding rotor blades, and a turbine casing supporting the stator blades and accommodating the turbine rotor, the rotor blades and the stator blades, the steam turbine being configured such that the rotor blades are paired with the corresponding stator blades to form turbine stages arranged in an axial direction of the turbine rotor, thereby forming steam paths.

2. The steam turbine blade as set forth in claim 1, wherein a content of the nanosheet particles is set within a range of 1 to 90 vol % for all of the coating film.

3. The steam turbine blade as set forth in claim 1, wherein the nanosheet particles have respective minute structures which are stacked and oriented.

4. The steam turbine blade as set forth in claim 1, wherein a thickness of the coating film is set within a range of 0.01 to 10 μm.

5. A method for manufacturing a steam turbine blade to be employed as one of stator blades or one of rotor blades in a steam turbine, the steam turbine including a turbine rotor, the rotor blades implanted in the turbine rotor, the stator blades provided in an upstream side of the corresponding rotor blades, and a turbine casing supporting the stator blades and accommodating the turbine rotor, the rotor blades and the stator blades, the steam turbine being configured such that the rotor blades are paired with the corresponding stator blades to form turbine stages arranged in an axial direction of the turbine rotor, thereby forming steam paths, comprising:

coating a solution at a surface of the steam turbine blade, the solution containing a ceramic precursor made of zirconium oxide to be a ceramic matrix and nanosheet particles made from silicon oxide configured to provide an oxygen barrier property, each of the nanosheet particles being within a range of 0.5 to 10 nm in thickness and within a range of 0.1 to 10 μm in lateral size; and heating the solution coated thereat to form a coating film containing the ceramic matrix and the nanosheet particles dispersed in the ceramic matrix;

wherein each of the nanosheet particles has a lateral size of about 1 μm, a thickness of about 1 nm, and is added into zirconium acetate containing water solution.

6. The method as set forth in claim 5, wherein a temperature when heating the solution coated to form the coating film is set within a range of 80 to 600° C.

7. The steam turbine blade as set forth in claim 1, wherein each silicon oxide nanosheet particle has a lateral size of about 1 μm and a thickness of about 1 nm.

8. The method as set forth in claim 5, wherein the nanosheet particles are added into about 7 wt % zirconium acetate containing water solution.

* * * * *